United States Patent [19]

Beale

[11] Patent Number: 4,945,726

[45] Date of Patent: Aug. 7, 1990

[54] LEAKY GAS SPRING VALVE FOR PREVENTING PISTON OVERSTROKE IN A FREE PISTON STIRLING ENGINE

[75] Inventor: William T. Beale, Athens, Ohio

[73] Assignee: Sunpower, Inc., Athens, Ohio

[21] Appl. No.: 397,182

[22] Filed: Aug. 23, 1989

[51] Int. Cl.[5] ..... F02G 1/04

[52] U.S. Cl. ..... 60/520

[58] Field of Search ..... 60/520

[56] References Cited

U.S. PATENT DOCUMENTS 3,487,635 1/1970 Prast et al. ..... 60/520

4,183,214 1/1980 Beale et al. ..... 60/520

*Primary Examiner*—Allen M. Ostrager

*Attorney, Agent, or Firm*—Frank H. Foster

[57] ABSTRACT

The invention is for the prevention of power piston overstroke in a Stirling cycle machine, wherein there is a gas valve which vents the gas spring acting upon the displacer. The valve and its accompanying control system switch on a leak in the gas spring to vent the gas spring upon piston stroke beyond a selected magnitude. This reduces the spring constant which reduces the displacer amplitude and phase lead over the power piston and thereby reduces power output.

10 Claims, 4 Drawing Sheets

LEAKY GAS SPRING VALVE FOR PREVENTING PISTON OVERSTROKE IN A FREE PISTON STIRLING ENGINE

TECHNICAL FIELD

This invention relates to a method and accompanying apparatus for preventing power piston overstroking in a free piston Stirling cycle machine. BACKGROUND ART The increased economic feasibility of utilizing energy from solar energy collector concentrators and the like as well as the burning of inexpensive waste products has increased the attractiveness of the free piston Stirling engine as a machine for directly converting heat energy to mechanical energy. Also, Stirling cycle heat pumps are effective machines for pumping heat from a cold mass to a warm mass and for utilization in refrigeration and heating systems.

The Stirling cycle engine has been known for decades and relies upon the pressure variations of a mass of working fluid confined in a work space. These pressure variations are caused by the alternate heating and cooling of the working fluid which is forced by a displacer piston between communicating hot space and cold space portions of the work space. One engine which offers advantages is the free piston Stirling engine of the type illustrated and described in the U.S. Patents of W.T. Beale, such as U.S. Pat. Nos. 3,552,120; 3,645,649; and 3,828,558, as well as French Pat. Nos. 1,407,682 and 1,534,734. These engines require no synchronizing mechanical connection between their displacer piston and power piston.

In the free piston Stirling engine, the displacer and power piston reciprocate at the same frequency but with position-time characteristics which are different and not in phase.

Although Stirling engines can be designed to operate efficiently under a selected set of conditions including a selected load, problems have been encountered when the power demand of the load varies. For example, the required output may change substantially over a period of time due to fluctuations in the load required at any one particular period of time. Because a Stirling engine with a constant input temperature has a tendency to continue delivering power at the same rate per unit of stroke, it will begin to overstroke if the power demand of the load becomes less. Such an effect can result in damage to the engine, and is clearly most undesirable.

Recent efforts involving improved free piston Stirling engines include U.S. Pat. Nos. 4,183,214 and 4,458,495 which relate to particular power control systems. U.S. Pat. No. 4,408,456 discloses a power control device for a free piston Stirling engine which utilizes a gas spring volume control which is controlled by the displacer sensor for adjusting the gas spring stiffness to control the amplitude and phase of the displacer required to produce the power to meet the engine load requirements.

Accordingly, it is an object of the present invention to provide an improved Stirling engine which can quickly, simply and efficiently provide for reliable mechanical damping to prevent an overstroking power piston.

BRIEF DISCLOSURE OF INVENTION

This invention relates to a method and accompanying apparatus for the regulation of engine power in a simpler fashion than presently known electronic or other load control systems.

The invention relates to a free piston Stirling engine which contains a pressurized working gas and has a displacer reciprocally mounted in the work space and engaged by a gas spring and a displacer rod or other means to provide the differential area to enable the pressure variations to drive the displacer in the proper phase. The engine also has a power piston reciprocally mounted in a cylinder, which is connected at one end to the work space to be acted upon by the working gas.

The improvement in this system involves the gas spring of the displacer. The displacer gas spring chamber is connected in communication with a valve. The valve is designed to both connect and to at least partially open and close the connection in response to a suitable mechanism which detects a stroke position of the power piston beyond a selected stroke amplitude. Consequently, working gas is permitted to pass between displacer gas spring and a space at a lower pressure, so as to reduce the effective spring constant of the gas spring. This reduction of the spring constant makes the spring less "springy" and changes the phase of the displacer causing its lead with respect to the power piston to be reduced thereby reducing power output and enabling the power piston stroke to find a new and greater, but still non-damaging piston stroke with a reduced engine power output in equilibrium with a reduced load.

The invention also comprises a method for controlling the power output of a free piston Stirling engine. The method involves the steps of controlling the gas spring constant of the displacer gas spring by venting the gas spring in response to piston stroke beyond a selected stroke amplitude.

Figure 1:
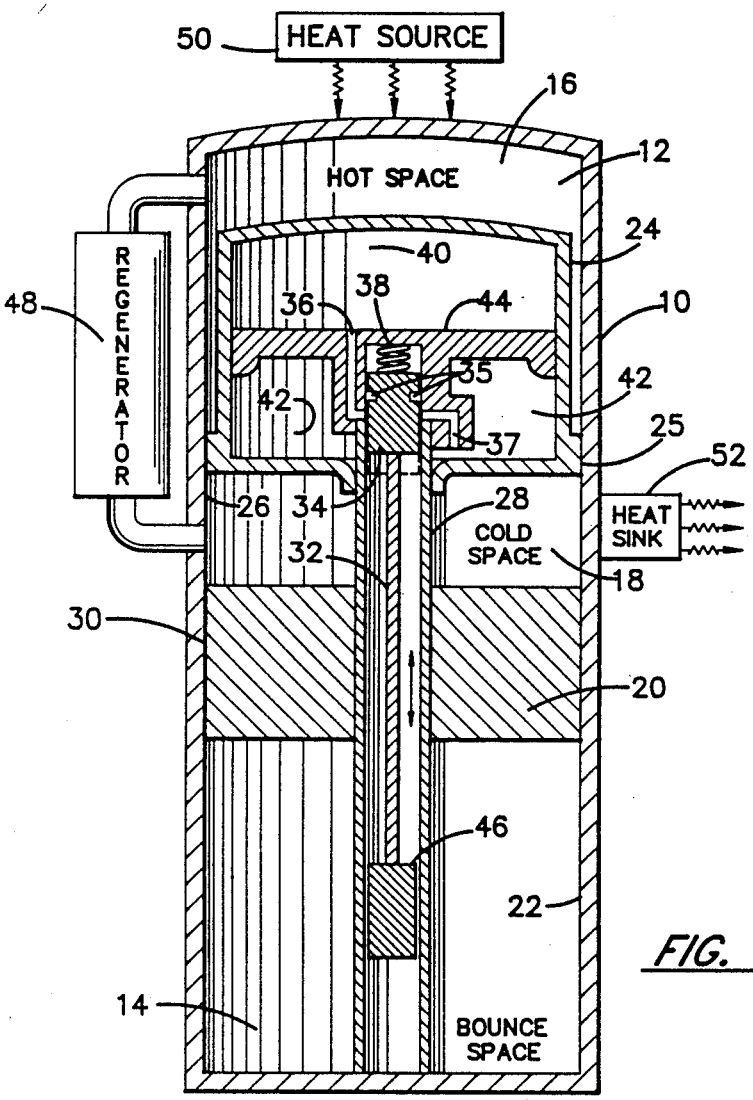
FIG. 1 is a diagrammatic view of a free-piston Stirling engine featuring the leaky displacer gas spring and accompanying valve means of the present invention in a preferred embodiment.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

FIG. 1 illustrates a free-piston Stirling engine having a housing 10 enclosing a work space 12 and a buffer or bounce space 14. The work space 12 is subdivided further into a hot space 16 and a cold space 18. These spaces are filled or charged with a pressurized gas, such as air or hydrogen, which is suitable for use in the Stirling engine.

The work space 12 is separated from the bounce space 14 by a power piston 20 which is reciprocally mounted in a power piston cylinder 22. A regenerator 48 may be provided for enhancing the operation of the engine in a manner wellknown in the art.

A displacer 24, having a relatively small mass but a substantial volume and having a seal 25 is reciprocally slidable in a displacer cylinder 26 formed in the work space 12. The interior of the displacer 24 is divided into two cavities 40 and 42 which form first and second displacer gas springs, respectively, and which are separated by a displacer gas spring piston 44, which is connected to a displacer rod 28. This provides a double acting gas spring acting upon the oscillating displacer.

The displacer rod 28 is fixed to the housing 10. The power piston 20 reciprocates along the rod 28 on its inner bearing surface 30. The displacer rod 28 is hollow and contains a rod 32 fixedly secured at its upper end to valve means 34, which is preferably a spool valve. Spool valve 34 includes annular recess 35, which, when the valve is in the open position, connect ports 36 and 37, which are in fluid communication with cavities 40 and 42, respectively.

A spring means 38, which can be a mechanical (as shown) or also a gas spring, connects the upper surface of valve 34 to the piston 44. Spring 38 3xerts a bias force which in the preferred embodiment urges the spool valve 34 upward so as to block the valve connection between the ports 36 and 37. When the spring bias force is overcome by a downward force upon rod 32, the valve opens and connects the ports to connect the two cavities 40 and 42 and thereby reduces the spring constant and increases the damping of the gas spring acting upon the displacer. Rod 32 is connected at its lower end to valve control means 46.

Valve control means 46 responds to the movements of power piston 20 and controls, by utilization of mechanical, electrical or pneumatic means, the spool valve 34. Examples of such a control structure are described below.

The structure of FIG. 1 is operated as an engine or motor by the application of heat from the heat source 50 to the associated hot space 16 and the removal of heat from the cold space 18 by means of a heat exchanger or heat sink 52. As is well-known in the prior art, devices of the type generally described above may also be operated as refrigeration and heating devices or for other heat pump applications by applying reciprocating mechanical energy to the power piston. It should therefore be understood and is intended that the structure of the present invention may be used advantageously in all these modes of operation of a Stirling cycle device.

Since the displacer of a free piston Stirling engine is mechanically independent of the power piston, its movement is determined solely by the gas pressure, spring forces and damping forces acting on it. Likewise, the power piston motion is determined by the gas pressure, spring forces and damping forces acting on it. The damping forces include friction, gas leakage and a variety of load forces. Also, there are several damping components in evidence as each of the moving components has a damping effect associated with its movement: the displacer dissipates energy in shuttling back and forth and the power piston transfers energy into the device it is driving. Also, there are frictional losses closely associated with these movements. The magnitude of the total damping components varies as a function of the load. The control system compensates for load variations in order to maintain a stable and efficient operation and eliminate damaging piston overstroke.

A different spring constant may be desired under different load conditions in order to maintain the desired phase and amplitudes. The appropriate spring constant is dependent upon such factors as the mass of the displacer, the mass of the power piston, the gas and its pressure and the particular volume of the gas containing compartment. In each embodiment of the invention the spring constant may be determined during the design of a particular engine by using the well known gas laws to provide the spring constant which is appropriate for each particular device to maintain resonance and the proper phase angle.

Figure 8:
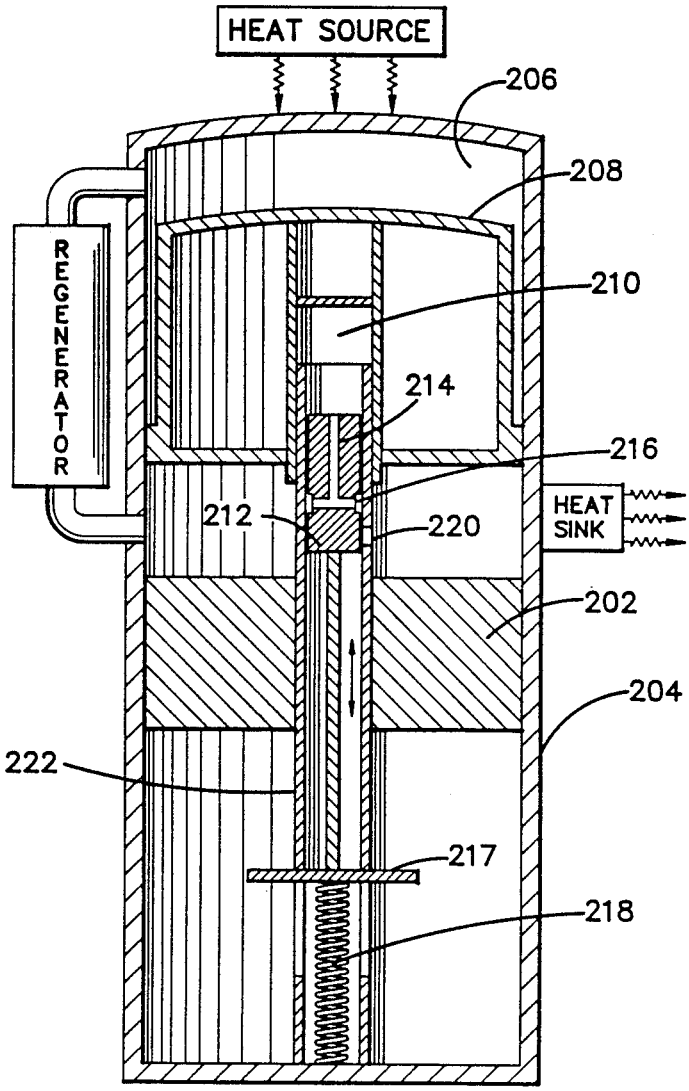
FIG. 8 is a diagrammatic view illustrating the use of a single gas spring acting upon the displacer and its communication to the work space.

The present invention can be illustrated by several embodiments which each utilize a valve means to control a desired gas flow between the two active spaces of the displacer gas spring so as to reduce the pressure variations of the gas spring when the valve is actuated by piston stroke beyond a predetermined point. FIG. 8 illustrates a differing embodiment of the invention with a single acting, simple gas spring.

Figure 2:
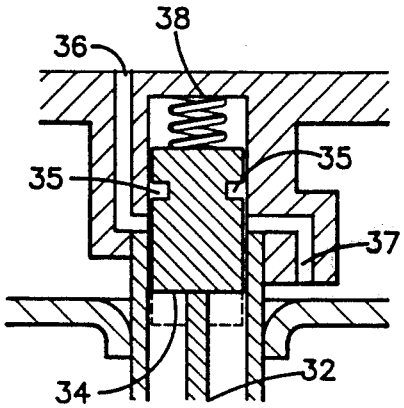
FIG. 2 is a diagrammatic view of a spool valve for connecting gas flow between first and second displacer gas springs.

FIG. 2 discloses a magnified view of a preferred embodiment of the spool valve utilized in FIG. 1, with ports 36 and 37 each being connected to the two cavities which provide the displacer gas spring. The rod 32 connected to the valve control means 46 axially moves so as to either open or close the valve. The precise components used for each of the spool valve elements is not critical and can be modified by one skilled in the art.

The valve is closed during power piston stroke below a selected valve activating magnitude, but opens either completely or a proportional amount in response to positions of the power piston in excess of the valve activating magnitude to thereby permit working gas to pass from the displacer gas spring at the higher pressure through the valve to the gas spring at the lower pressure. Thus, the valve is controlled so that it is closed for all stroke positions of the power piston of a magnitude equal to or less than a predetermined position. However, upon initiation of piston stroke beyond the valve activating magnitude, the valve means opens either completely or a proportional amount which is suitable for regulating the displacer gas springs by passing gas through the valve to enable the piston stroke to increase to a new, equilibrium magnitude which is a greater, but non damaging stroke to the engine. In a sense, the invention is a damping system which operates so as to easily and quickly limit the power piston stroke of the engine upon reduced load to prevent damaging the engine. Opening the valve reduces the effective spring constant which in turn retards the displacer to reduce its lead over the piston to reduce engine power. It also increases damping which also reduces power supplied by an engine.

The effect of the motion of the valve for this "leaky" gas spring is to render the gas spring which acts upon the displacer less stiff and more lossy, i.e., more leaky. This in turn reduces the displacer amplitude and phase lead over the power piston, which reduces engine power. The reason for the reduction in power is that the function of the displacer is to move the gas around the heat exchanger loop between the cold and hot spaces in the working gas space of the engine and a reduction of displacer amplitude and phase lead reduces the fraction of gas moved through this loop, and thus causes a consequent drop in power.

Figure 3:
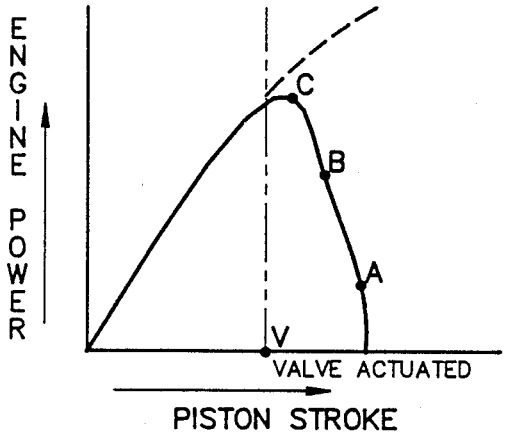
FIG. 3 is a graph setting forth the relationship between engine power and increasing piston stroke in a free piston Stirling engine embodying the present invention.

In FIG. 3 the result of the aforementioned variations in the displacer gas spring can be seen as the change in engine power is plotted against the particular magnitude of the power piston stroke for the FPSE using the leaky gas spring of the invention. As can be seen, engine power initially rises in the conventional manner as the power piston stroke increases until the piston attains the magnitude V of the valve activating stroke at which it opens the spool valve. In the absence of the present invention, this characteristic curve extends as illustrated by the dashed lines. At this selected stroke amplitude with the present invention, however, engine power ceases to rise with increasing piston stroke and instead decreases more and more rapidly as the stroke continues to increase. This enables the free piston Stirling machine to operate at a stable equilibrium along this curve to the right of the selected piston amplitude V.

In one example the engine operates at point A in FIG. 3, where the stroke is high and the valve is wide open, with the displacer amplitude and phase lead being low, and the resulting engine power low. The result of the operation of the leaky valve is to "bend" the curve of Engine Power vs. Piston Stroke downwardly at piston stroke magnitudes beyond the valve activating stroke magnitude. This "bending" permits the attainment of a new equilibrium stroke which is of a greater piston stroke magnitude that will not damage the engine. As a consequence the desired operating line of the engine is that between the points A–C, and not, as is the usual case, along a line which extends toward large amplitudes where the machine would otherwise operate if load is reduced but the input drive temperature remains constant. The resulting operation on a line of falling power with increasing stroke is inherently stable, and no further power control methods are required. For example, at point A the engine may be producing only enough power to drive itself against its internal friction and auxiliary load. However, as load increases, piston stroke decreases, and power increases.

Figure 4:
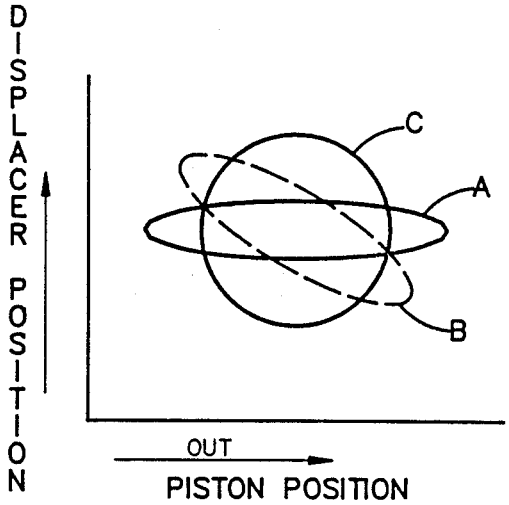
FIG. 4 is a plot of the corresponding positions of the displacer piston and the power piston for the points A, B, and C which are illustrated in FIG. 3.

In FIG. 4, the relationship between the piston and displacer positions for three plots corresponding to points A, B, and C of FIG. 3, has been set forth and illustrates the phase relationships between the two respective positions of the pistons in the Stirling engine cycle.

Figure 5:
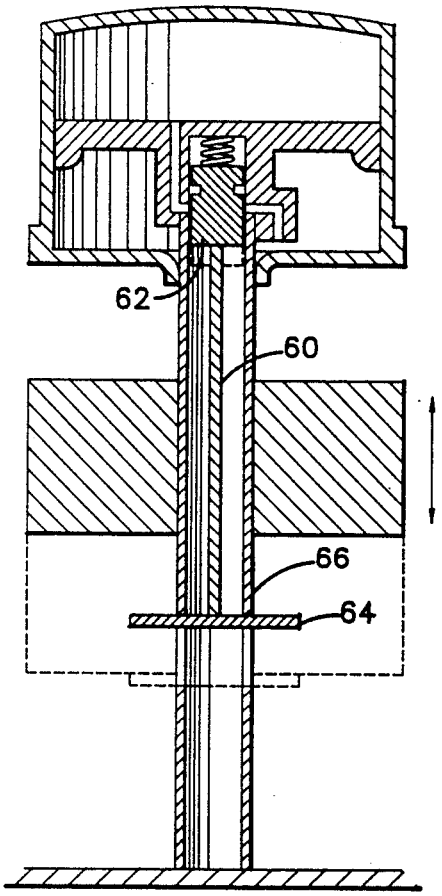
FIG. 5 is a diagrammatic view of the free piston Stirling engine in which the means for detecting piston overstroke includes a striking bar that is connected to the rod which is connected to the valve.
Figure 6:
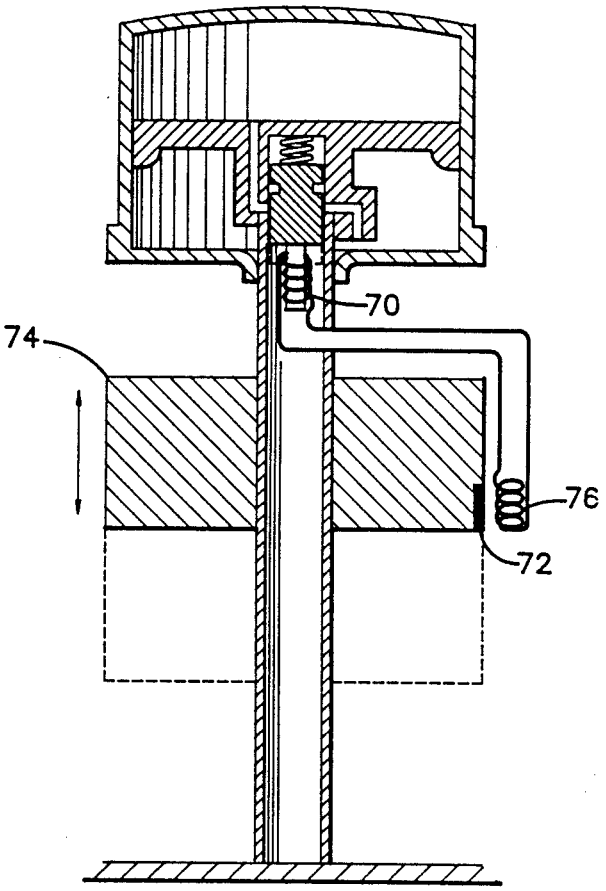
FIG. 6 is a diagrammatic view similar to FIG. 5 in which the means for detecting overstroke is a simple electrical current generator.
Figure 7:
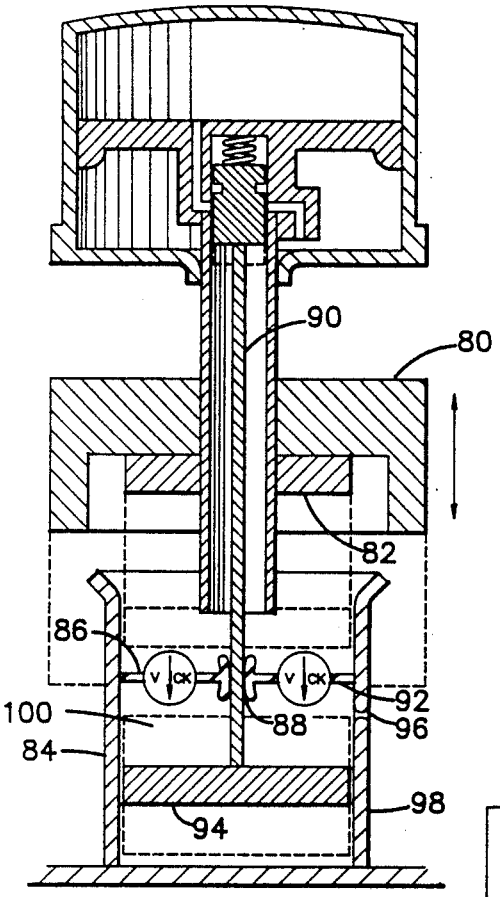
FIG. 7 is also a diagrammatic view similar to FIGS. 5 and 6, in which the means for detecting piston overstroke is a pneumatic arrangement, in which a central boss on the power piston upon overstroke mates with a cylinder to form a pump to cause pumped gas to axially pull a rod connected to the valve means.

FIGS. 5–7 each disclose different types of control mechanisms for regulating the operation of the spool valve that are known to those skilled in the art. FIG. 5 sets forth an embodiment like FIG. 1, in which a rod 60 is connected at its upper end to the lower surface 62 of the spool valve and at its lower end to a striking bar 64. Rod 60 can axially reciprocate inside the displacer rod column 66, with the reciprocation being determined by piston contact with the striking bar 64, which protrudes out of an opening in column 66 and is firmly attached to the lower end of the rod 60. The striking bar 64, when struck and downwardly moved by the descending power piston upon a piston stroke magnitude exceeding the valve activation magnitude, pulls the rod 60 axially downward and thereby opens the spool valve to which the rod is attached and permits gas flow therethrough.

FIG. 6 discloses another mechanism which can control the axial reciprocation of the rod that is attached to the spool valve lower surface. This embodiment involves a solenoid in which a section of coiled wire 70 is wound around a truncated rod which is connected to the lower surface of the valve, and a magnet 72 which is attached to the outer surface of the reciprocating piston 74. Upon occurrence of sufficient piston stroke, the magnet is moved sufficiently close to induce an electric current in an adjacent section of coiled wire 76 to create a downward force in section 70 which pulls on the truncated rod and thereby pulls the valve downward and opens it.

FIG. 7 discloses a pneumatic arrangement for opening and closing the valve means 78. The power piston 80 includes a central boss 82 forming a piston which, upon sufficient piston stroke downwardly, descends to sealingly extend into and compress the gas within a cylinder 84. The cylinder 84 has a central plate 86 of disc-like shape and includes a sealed opening 88 through which the rod 90 slidably but sealingly passes. A pair of check valve means 92 permit gas flow into section 100. Rod 90, which is connected at its upper end to the valve is also connected at its lower end to a piston 94 that sealingly reciprocates within the cylinder 84. The cylinder 84 has a small bleeder hole or leak 96 in the container wall 98, the leak being located above the maximum height to which the piston 94 travels. The hole 96 is sized to allow only a slow leak to release at a desired rate the accumulated gas which passes through the valve opening into space 100. In the operation of the embodiment of FIG. 7, whenever the piston 80 strokes sufficiently to cause the boss 82 to extend into the cylinder 84, gas will be pumped through the check valves 86 and 92. Thus, each stroke of that amplitude or greater will pump gas into the lower space 100 within the cylinder 84. The accumulation of gas in that space 100 causes the piston 94 to descend until it descends sufficiently to actuate the valve 78, causing the spring to be lossy. The bleeder hole 96 permits the gas to slowly bleed out so that in the event of a reduced piston stroke, the valve 78 will return to its closed position.

The embodiment of FIG. 8 illustrates a free piston Stirling cycle machine in which the piston 202 is reciprocatingly mounted in a cylinder 204 and is acted upon by the working gas 206. The working gas is moved in a conventional manner by the displacer 208. The displacer 208 is acted upon by a displacer gas spring 210 formed in the interior of the displacer 208. A sliding spool valve 212 provides a communication from the gas spring 210 through the longitudinal passage 214 to an annular groove 216.

When the stroke of piston 202 is sufficient so that the piston contacts a cross bar 217 the spool valve 212 is moved downwardly against the bias of its spring 218 to align the annular groove 216 with an outlet port 220 which maybe in the bounce space through the displacer and piston axial rod 222. In this manner the gas spring 210 is vented for piston strokes sufficiently large to contact the cross bar 217, and otherwise is not vented.

Figure 9:
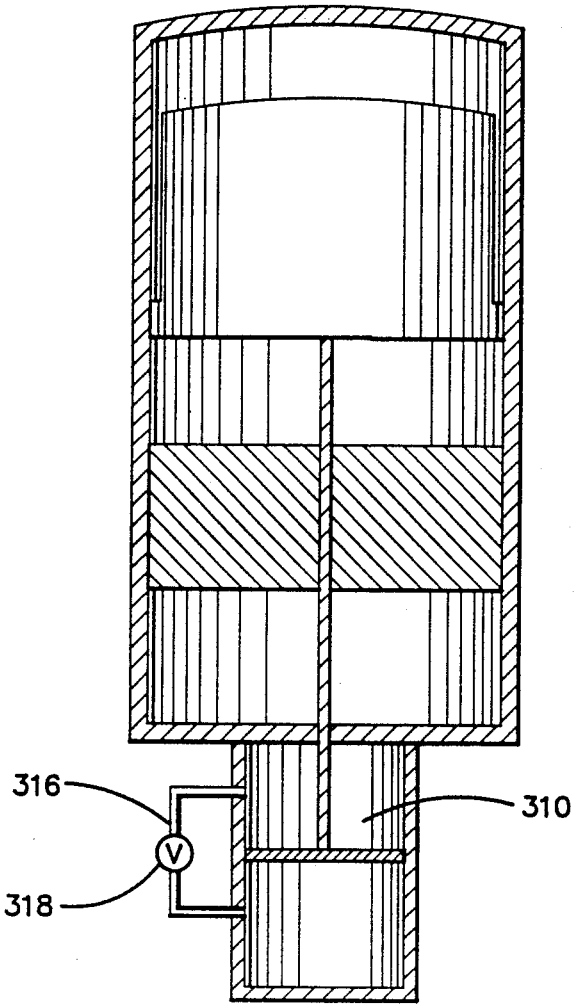
FIG. 9 is a diagrammatic view of an alternative embodiment of the invention.

FIG. 9 illustrates another embodiment in which the gas spring 310 is remote and its two portions 312 and 314 are interconnected by a passageway through tube 316 through a valve 318. The valve 318 operates like the other valves by a mechanical pneumatic, electrical, electronic or other feedback linkage to open when the piston stroke reaches a selected amplitude to operate equivalently to the other embodiments.

It is to be emphasized that these embodiments are merely exemplary, and a number of other embodiments which are well known to those skilled in the art may also be utilized. While certain preferred embodiments of the present invention have been disclosed in detail, it is to be understood that various modifications may be adopted without departing from the spirit of the invention or scope of the following claims.

I claim:

1. In a free piston Stirling machine, including a displacer reciprocally mounted in a working gas space and engaged by a gas spring and having a piston mounted for reciprocation in a cylinder and acted upon by the working gas, the improvement comprising:

(a) means for detecting piston amplitude beyond a selected amplitude during its reciprocation; and (b) valve means connected in communication with the gas spring for permitting the connection of the gas spring to another gas space; and (c) actuating means connected between the detecting means and the valve means for opening the valve means in response to detection of piston amplitude in excess of said selected amplitude to reduce the spring constant and make the gas spring more lossy and thereby increase its damping and for closing the valve means in response to the absence of piston amplitude in excess of said selected amplitude.

2. A machine in accordance with claim 1 wherein the gas spring has a pair of oppositely acting chambers and said valve means is in communication between said chambers.

3. A machine in accordance with claim 1 wherein the valve means is connecting in communication with the work space to permit exhaust of gas from the gas spring to the work space.

4. A free piston Stirling machine in accordance with claim 1 wherein (a) a displacer gas spring piston is mounted within an interior chamber of the displacer, the piston separating the chamber into first and second cavities that form first and second gas springs, respectively; and (b) said valve means has a first port in communication with the first cavity and a second port in communication with the second cavity, the valve means adapted for connecting and opening and closing the connection between the first and second cavities.

5. Apparatus in accordance with claim 1 wherein the valve means is a spool valve.

6. Apparatus in accordance with claim 4 wherein the valve means has an upper and lower surface, a spring means connected to the upper surface and a valve activation rod having an upper and a lower end connected at the upper end to the lower surface, the spring means in relaxed condition closing the connection and in extended, tension condition opening the connecting between the first and second cavities.

7. Apparatus in accordance with claim 6 wherein the valve activation rod is adapted for axial reciprocation inside the displacer rod and controlled by a piston stroke magnitude detection means.

8. Apparatus in accordance with claim 7 wherein the means for opening and closing the valve means is an electrical current generator.

9. A method for preventing piston overstroke in a free piston Stirling machine including a displacer reciprocally mounted in a working gas space and engaged by a gas spring and having a piston acted upon by the working gas, the improved method comprising:

effecting the venting of the gas spring to reduce its effective spring constant and increase its damping lossiness in response to piston amplitude beyond a selected amplitude.

10. A method in accordance with claim 9 wherein the gas spring is vented as a monotonically increasing function of the magnitude of the piston amplitude.

* * * * *